United States Patent [19]

Panaro

[11] 4,134,093

[45] Jan. 9, 1979

[54] ELECTRIC FUSE

[75] Inventor: Robert J. Panaro, Byfield, Mass.

[73] Assignee: Gould Inc., Rolling Meadows, Ill.

[21] Appl. No.: 793,516

[22] Filed: May 4, 1977

[51] Int. Cl.[2] ..... H01H 85/20

[52] U.S. Cl. ..... 337/252; 337/187

[58] Field of Search ..... 337/252, 253, 186, 187, 337/188, 189, 190, 191, 192, 193; 339/277 R, 147

[56] References Cited

U.S. PATENT DOCUMENTS

| | | | |
|---|---|---|---|
| 930,606 | 8/1909 | Morgan | 337/252 |
| 2,713,098 | 7/1955 | Swain | 337/229 |
| 2,767,283 | 10/1956 | Jung | 337/187 |

FOREIGN PATENT DOCUMENTS

| | | | |
|---|---|---|---|
| 225341 | 9/1910 | Fed. Rep. of Germany | 337/252 |

*Primary Examiner*—Harold Broome
*Attorney, Agent, or Firm*—Erwin Salzer

[57] ABSTRACT

This invention relates to electric fuses having rectangular terminal members which facilitate the insertion of the fuses into an electric circuit. According to this invention one arm of each terminal member is provided with a drawn-out cylindrical projection, or drafted hole, and the ferrules of the fuse are pressfitted into said cylindrical projection, or drifted hole, thus avoiding the use of any solder means between said ferrules and said cylindrical projections, or drifted holes.

3 Claims, 4 Drawing Figures

ELECTRIC FUSE

BACKGROUND OF THE INVENTION

Fuses according to this invention are generally used as semiconductor fuses and, therefore, have low $i^2.t$ values and low $i_p$ let-through currents. However, fuses embodying this invention are not limited to the above purpose of protecting semiconductor devices.

It appears that the ancestor of fuses of the kind under consideration are disclosed in U.S. Pat. No. 2,713,098 to K. W. Swain, July 12, 1955 for CURRENT-LIMITING FUSIBLE PROTECTIVE DEVICES. These composite fuses performed quite satisfactorily, but the terminal members used for connecting the fuses into the electric circuit to be fused were quite expensive to manufacture.

A simple but less desirable solution consisted in affixing rectangular terminal members to the end surface of the ferrules of the fuses. Solder joints were arranged at the interfaces between the terminal members and the end surfaces of the ferrules of the fuses to minimize the electrical resistance between these two parts. These solder joints have a tendency to melt at currents at which the fuse or fuses do not yet blow.

In another kind of prior art fuses the aforementioned solder joints were replaced by large masses of solder, inserted between the ferrules of the fuses and the terminal members. These heat sinks prevent the fusion of the solder at overloads at which the fuse or fuses do not blow, however, require large masses of solder which greatly increase the weight and the price of the fuses.

It is the principal object of this invention to provide improved fuses not subject to the above drawbacks and limitations of prior art fuses. A more specific object of this invention is to provide fuses whose voltage drop is small in the absence of any solder or similar joint. Other objects and advantages of this invention will become apparent as this specification proceeds.

SUMMARY OF THE INVENTION

Fuses embodying this invention include a pair of spaced substantially rectangular terminal members of sheet metal bent 90 degrees to form a pair of arms. Each terminal member has a connecting perforation at one of the arms thereof and each terminal member has a drawn-out cylindrical projection or a drifted hole open at both ends at the other of the arms thereof. The drifted hole, or tubular extension, in each of the arms of both terminal members extends axially inwardly into the space bounded by the arms that are provided with a drifted hole. A fuse embodying this invention further includes fusible element means, a pulverulent arc-quenching filler surrounding said fusible element means, a casing of insulating material housing said fusible element means and said filler, and ferrule means conductively interconnected by said fusible element means closing both ends of the casing.

Each of said ferrule means is press-fitted into said drawn-out cylindrical projections, or drifted holes, of one of said arms to such an extent that the end surfaces of said ferrule means are substantially flush with the plane defined by one of said arms.

DESCRIPTION OF PREFERRED EMBODIMENT

Figure 1:
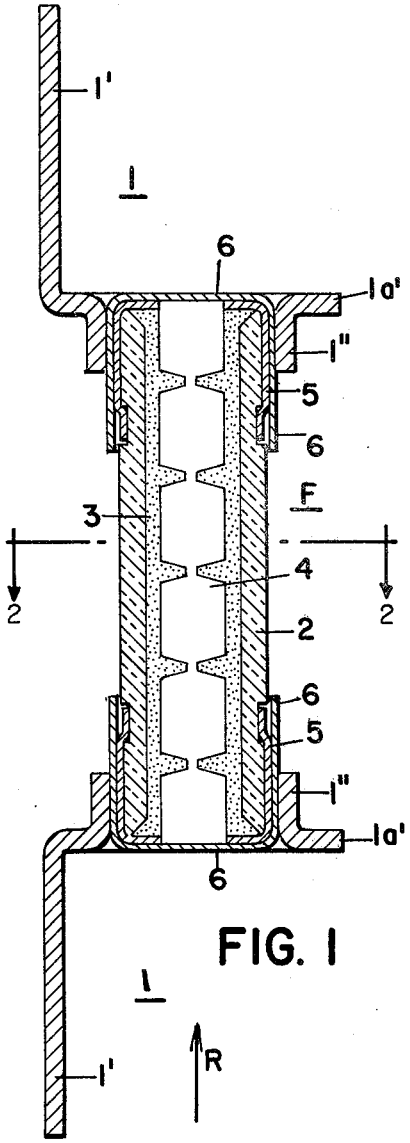
FIG. 1 is a longitudinal side view of an electric fuse embodying the present invention, showing such a fuse on a larger scale than actual size and on a larger scale than FIGS. 3 and 4.
Figure 2:
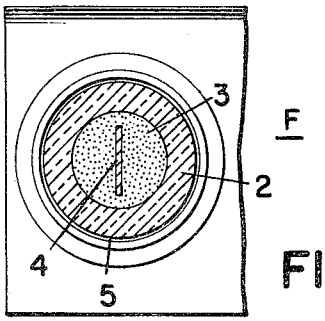
FIG. 2 is a cross-sectional view along 2—2 of FIG. 1, again on a larger scale than actual size and on a larger scale than FIGS. 3 and 4.
Figure 3:
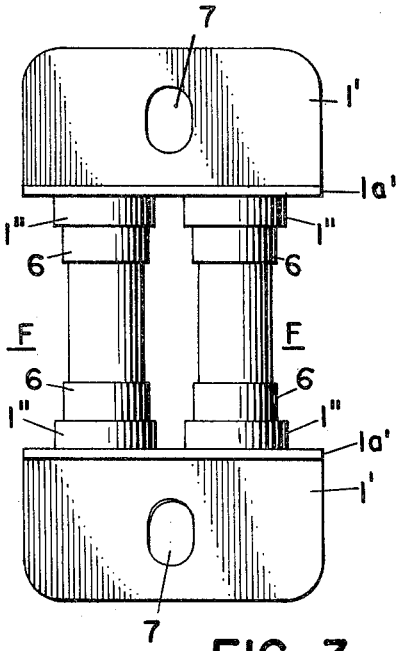
FIG. 3 is a frontal view of the device shown in FIG. 1.
Figure 4:
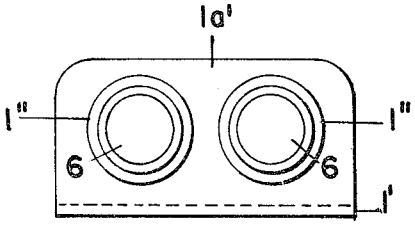
FIG. 4 is an axial view of FIG. 1 seen in the direction of arrow R of FIG. 1.

Referring now to the drawings, numeral 1 has been applied to indicate one of a pair of spaced rectangular terminal members with stamped out perforations 7. The purpose of perforations 7 is to facilitate connection of the fusible device into the electric circuit to be fused. Terminal member 1 has a first arm 1′ and a second arm 1*a*′ which is angularly bent 90° as shown in FIG. 3 where 1′ is in the plane of the paper and 1*a*′ extends perpendicular to said plane. Each of arms 1*a*′ has a drawn-out cylindrical projection or drifted hole 1″ open at both ends and extending along the same axis, but in opposite directions. A pair of fuses F including casings 2 of insulating material each houses a fusible element 4 embedded in a pulverulent arc-quenching filler 3. Each end of casing 2 is provided with an inner ferrule 5 conductively interconnected by said fusible element 4. Casing 2 is effectively sealed by addition of outer ferrules 6. Outer ferrules 6 are press fitted over inner ferrule 5 and subsequently press fitted into said drifted holes 1″ of terminal member arms 1′. Said press fitting of ferrules 6 into drifted holes 1″ makes it unnecessary to provide solder joints as in the aforementioned prior art fuse holders. Ferrules 6 are press fitted into drifted hole 1″ to such an extent that the end surfaces of ferrules 6 are coextensive with the plane defined by terminal arms 1*a*′ cylindrical projections 1″ are at right angles to the planes defined by arms 1*a*′.

The process of forming the terminal members comprising parts 1, 1′,1*A* ′, 1″ is essentially the consecutive four step operation of:

(a) blanking-hole 7 out of a flat sheet of metal;

(b) forming cylindrical projections 1″;

(c) bending the stock 90° to form the arms 1′ and 1*a*′ *of the terminal member; and*

(d) trimming.

I claim as my invention:

1. An electric fuse comprising (a) a pair of spaced terminal members of sheet metal each having a pair of substantially planar arms, said arms enclosing an angle of 90 degrees, one arm of each of said pair of arms having a connecting perforation and the other of said pair of arms having a drawn-out cylindrical projection that extends axially inwardly and is open at both ends;

(b) a fuse including fusible element means, a pulverulent arc-quenching filler surrounding said fusible element means, a casing of insulating material housing said fusible element means and said filler, and ferrule means conductively interconnected by said fusible element means closing both ends of said casing; and (c) each of said ferrule means being press-fitted into said drawn-out cylindrical projection in said other of said pair of arms and the end surfaces of said ferrule means being flush with the planes defined by said other of said pair of arms.

2. An electric fuse comprising (a) a pair of spaced terminal members of sheet metal each having a pair of substantially planar arms, said arms enclosing an angle of 90 degrees, one arm of each said pair of arms having a connecting perforation and the other of each of said pair of arms having a drawn-out cylindrical projection extending axially inwardly and being open on both ends thereof;

(b) a fuse including fusible element means, a pulverulent arc-quenching filler surrounding said fusible element means, a casing of insulating material housing said fusible element means and said filler and a pair of ferrules at each end of said casing conductively interconnected by said fusible element means and each said pair of ferrules closing one of the ends of said casing; and (c) the outer of said pair of ferrules being press-fitted into said cylindrical projection in each of said other pair of arms and establishing electric contact between said pair of ferrules and said cylindrical projection in each of said other pair of arms merely by the pressure prevailing between these parts, and the end surfaces of said pair of ferrules being substantially flush with the planes defined by said other of said pair of arms.

3. An electric fuse comprising a fuse tube of electric insulation, a body of granular arc-quenching filler inside said fuse tube, fusible element means embedded in said arc-quenching filler, ferrule means arranged at the end of said fuse tube and conductively interconnected by said fusible element means, and a pair of spaced adapters of sheet metal each including a pair of substantially planar arms bent to enclose an angle of 90 degrees, one arm of each said pair of adapters having a perforation for connecting said one arm of each of said pair of adapters to a bus, and the other of each said pair of adapters being conductively interconnected by said fuse wherein the novel feature comprises a drawn-out aperture in said other arm of each said pair of adapters, each forming a tubular extension projecting axially inwardly at right angles to the plane defined by said other arm of each said pair of adapters, said extension being open on both ends and said ferrule means being press-fitted into said extension in said other arm of each said pair of adapters and the end surface of said ferrule means being substantially flush with the planes defined by said other arm of each said pair of adapters.

* * * * *